US005596855A

United States Patent [19]

Batch

[11] Patent Number: 5,596,855

[45] Date of Patent: Jan. 28, 1997

[54] INSITU INSULATED CONCRETE WALL STRUCTURE

[76] Inventor: Juan R. Batch, P.O. Box 3089, Odessa, Tex. 79766

[21] Appl. No.: 340,028

[22] Filed: Nov. 14, 1994

[51] Int. Cl.[6] ..... E04B 2/20

[52] U.S. Cl. ..... 52/309.11; 52/426

[58] Field of Search ..... 52/309.11, 309.12, 52/426; 411/466

[56] References Cited

U.S. PATENT DOCUMENTS

| | | | |
|---|---|---|---|
| 2,102,443 | 12/1937 | Thorn | 52/426 X |
| 2,316,819 | 4/1943 | Tedrow | 72/30 |
| 3,788,020 | 1/1974 | Gregori | 52/426 X |
| 4,223,501 | 9/1980 | De Lozier | 52/309.11 |
| 4,229,920 | 10/1980 | Lount | 52/426 X |
| 4,486,115 | 12/1984 | Rionda et al. | 411/466 X |
| 4,698,947 | 10/1987 | McKay | 52/309.12 |
| 4,706,429 | 11/1987 | Young | 52/309.12 |
| 4,731,968 | 3/1988 | Obino | 52/309.12 |
| 4,860,515 | 8/1989 | Browning | 52/426 |
| 4,879,855 | 11/1989 | Berrenberg | 52/309.11 |
| 4,884,382 | 12/1989 | Horobin | 52/426 |
| 4,889,310 | 12/1989 | Boeshart | 52/426 X |
| 4,936,540 | 6/1990 | Boeshart | 52/426 X |
| 4,938,449 | 7/1990 | Boeshart | 52/426 X |
| 5,459,970 | 10/1995 | Kim | 52/426 X |

*Primary Examiner*—Carl D. Friedman
*Assistant Examiner*—Beth A. Aubrey
*Attorney, Agent, or Firm*—Marcus L. Bates

[57] ABSTRACT

A module for building an insulated concrete wall structure by stacking the modules together until the desired configuration of a concrete form is completed, and when the form is filled, a concrete monolithic wall structure having foam insulation permanently attached to the opposed wall surfaces to form the inner and outer wall surfaces of an enclosure is realized. The module is made of foamed plastic material, such as styrofoam, for example, and is built in a pressure molding apparatus. Each module comprises a rigid foam block of rectangular configuration having a hollow interior of a particular predetermined configuration formed between spaced apart confronting sidewalls. The inner and outer styrofoam walls of the module are secured one to the other by a plurality of spaced tension members. Each tension member is made of a single perforated bent up sheet of thin metal, having opposed faces, with the opposed edges thereof terminating in end flanges arranged perpendicular to the wall faces of the confronting wall members and parallel respective to the inner and outer wall surfaces of the module. The opposed flanges of each tension member are imbedded within the styrofoam plastic and terminate near the wall surface thereof. The module provides a concrete form from which spaced parallel vertical load bearing columns tied together by spaced horizontal shear members can be realized.

11 Claims, 4 Drawing Sheets

INSITU INSULATED CONCRETE WALL STRUCTURE

BACKGROUND OF THE INVENTION

It is known to build insulated concrete wall structures by using a plurality of modules stacked together to provide a concrete form which can subsequentially be filled with cementatious material and thereby provide a unitary concrete wall structure. The patent to DeLozier 4,223,501 (assigned to applicant) teaches the use of such a module for the fabrication of a concrete monolithic wall structure having foam insulation permanently attached to the structure and forming the inner and outer wall surfaces. The main advantages of this method of building is that the concrete forms remain in place as a useful component of the wall structure. Reference is made to the DeLozier patent and to the an cited therein for further background of this invention.

When a plurality of the prior art modules are assembled into a concrete building form, the sides of the module often are of inadequate strength to provide the necessary support required to contain the wet cement until it can "set" and thereby become a self supporting monolithic concrete wall of an enclosure. Lateral movement of the module walls results in an unsightly and unacceptable wall surface, accordingly, it is absolutely necessary that something be done to increase the wall strength to where there is no doubt that the module walls will resist lateral movement occasioned by the hydrostatic head of the wet concrete. Consequently, it is common practice to augment the strength of the prior an modules by the employment of extraneous timbers assembled into a lattice work and tied against the module walls to help contain the wet cement until it can "set".

For this and other reasons, many skilled in the art prefer the old technique of building concrete forms made of 2×4 timbers and plywood tied together in a manner to provide a structure that adequately resists the hydrostatic pressure of the concrete, rather than utilize the more modem and cost effective foam plastic module.

The present invention provides improvements in foam plastic modules for use in building construction that overcomes the above disadvantages of lateral movement of the module walls and eliminates the need for the extraneous timbers. This is achieved by the provision of a special tension member imbedded within the foam plastic in a manner that secures the opposed wall structure together and thereby resists lateral movement thereof. After the wet concrete has set, the tension members provide a support for subsequent attachment of paneling and other decorative material that may be employed on the inner and outer wall surfaces of the structure.

Another advantage of the present invention is improvements realized in the configuration of the novel tension member that arranges the outer flange members thereof in equally spaced relationship along the length of the module so that the application of commercially available paneling is more easily achieved. A further advantage of the present invention is the improved resistance to misalignment of the novel tension member respective to the remaining structure of the module during the molding process of the module. An improved module having the above attributes is the subject of this invention.

SUMMARY OF THE INVENTION

Apparatus for building an insitu insulated concrete wall structure by the use of a plurality of modules stacked together to provide a continuous concrete form which results in a unitary wall structure when the interior thereof is filled with concrete. The resultant structure is a concrete monolithic wall structure having foam insulation permanently attached to the inner concrete structure and forming the inner and outer wall surfaces thereof. Accordingly, a plurality of the modules are easily assembled into a concrete building form to provide a new an inexpensive method of building a rugged monolithic wall of an enclosure. The module per se provides a new and novel building component by which the method of this invention can be carried out.

The module is built in a pressure mold using foamed plastic material, such as styrofoam, for example. Each module comprises a rigid, rectangular, block having a hollow interior of a particular configuration formed between spaced apart confronting sidewalls. The module further includes opposed ends and a top opposed to a bottom, and provides a concrete form within which there can advantageously be realized a concrete structure having spaced parallel vertical load bearing columns tied together by spaced horizontal sheer members, all of which is achieved after the concrete has been poured into the assembled modules.

The inner and outer styrofoam walls of the module are secured one to the other by a plurality of spaced vertically arranged tension members. Each tension member is made of a single perforated bent up sheet of thin metal, having front and rear faces, with the opposed edges thereof terminating in end flanges arranged perpendicular to the wall faces of the tension member and parallel respective to the inner and outer wall surfaces of the module. The flanges each have a flange face imbedded within the plastic near the inner and outer wall surfaces thereof. Large upper and lower holes are spaced equidistant from the flanges for flow of wet concrete therethrough in order to tie the opposed confronting module walls together and to the concrete structure. The upper marginal end of the tension member has a cutout formed therein that results in crescent shaped rebar seat that is connected to the upper end of the flanges by a web member that extends upwardly at a 45 degree angle.

A double row of tabs are formed below the rebar support on either side of the holes, and inwardly of the opposed flanges, with there being an inner and an outer row of tabs bent perpendicular respective to the tension member faces. Further, the inner and outer row of tabs are bent 90 degrees along a common plane or line for anchoring the outer marginal edge portion of the tension member within the polystyrene foam plastic of the module. Hence the tabs of each double row are oppositely bent toward one another in order to align tabs along a vertical line. The tabs form openings that are smaller in size compared to the upper and lower holes, and bond to the polystyrene to anchor the tension member thereto which results in an unexpected increase in resistance to deformation occasioned by the hydrostatic forces encountered as a result of the wet concrete. The outer edges of the walls of the module is in the form of tongue and groove construction for fastening the modules together in an interlocked manner at the top, bottom, upper, and lower edges thereof.

A primary object of the present invention is the provision of apparatus for building an insitu insulated concrete wall structure made of a plurality of modules stacked and fastened together to provide a concrete form which results in the formation of a unitary wall structure when the interior thereof is filled with concrete. The resultant is a concrete monolithic wall structure having foam insulation permanently attached to the structure and forming the inner and outer wall surfaces.

A further object of this invention is to disclose and provide a module that can be assembled into a concrete building form that provides a new method of building a monolithic wall structure of an enclosure.

A still further object of this invention is to disclose and provide a module that is built in a pressure mold using foamed plastic material, such as styrofoam, for example, and wherein each module comprises a foam block having a hollow interior to impart a particular configuration into a monolithic concrete load bearing column that is to be formed between spaced apart confronting sidewalls. The module has opposed ends, and a top opposed to a bottom, and forms a concrete structure having spaced parallel vertical load beating columns that are tied together by spaced horizontal members after concrete has been poured into the interior of the module.

Another object of this invention is to provide improvements in modules that have inner and outer plastic foam walls secured one to the other by a plurality of spaced tension members. Each tension member is made of a single perforated bent up sheet of thin metal, having front and rear faces, the opposed edges thereof terminate in end flanges arranged perpendicular to the faces and parallel respective to the inner and outer wall surfaces. The flanges each have a flange face disposed to be imbedded within the plastic near the wall surface thereof during the fabrication of the module. Large upper and lower holes are spaced equidistant from the flanges for flow of concrete therethrough. The upper marginal end of the tension member has a cutout formed therein that results in an edge that supports rebar thereon and is upwardly sloped into attached relationship respective to the upper end of the flanges.

A further object of this invention is to provide improvements in the configuration of a novel tension member that arranges the outer flange members thereof in equally spaced relationship along the length of the module so that the subsequent application of commercially available paneling is more easily achieved.

Another and still further object of this invention is the provision of a module that is built in a pressure mold using foamed plastic material, such as styrofoam, for example, and each module comprises a foam block having a hollow interior of a particular geometrical configuration formed between spaced apart confronting sidewalls, opposed ends, and a top opposed to a bottom. The module forms rigid, spaced, parallel, vertical concrete columns tied together by spaced horizontal members that are formed after the wet concrete has been poured. The inner and outer styrofoam walls are secured one to the other by a plurality of spaced tension members. Each tension member is made of a single perforated bent up sheet of thin metal, having front and rear faces, the opposed edges thereof terminate in end flanges arranged perpendicular to the faces of the member and parallel respective to the inner and outer wall surfaces of the module. Opposed flanges are embedded within the plastic of the confronting walls and regidify the modules as well as providing anchor means by which the plastic is firmly anchored to the concrete, and by which addition of panels can be achieved.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein, and which provides a new method for use in building construction.

DETAILED DESCRIPTION OF THE PREFERRED EMBODIMENT

Figure 1:
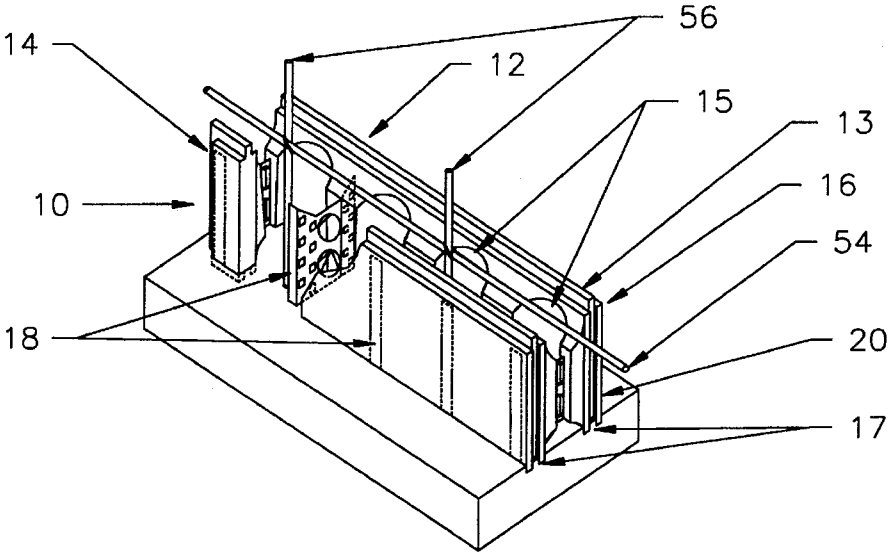
FIG. 1 is a fragmentary, broken, pictorial representation of the insitu insulated concrete wall structure of the invention.

In FIG. 1, together with other figures of the drawings, numeral 10 indicates a wall structure undergoing construction by using a modular construction block 12 of this invention. The modular construction block 12 can be attached to a plurality of similiar blocks or modules 12 of like or similiar dimensions to provide a structural form or mold within which recently mixed cementatious material can be poured, thereby forming a monolithic, composite, concrete wall of great structural integrity. Accordingly, the filled modular hollow blocks cooperate with one another to provide an insitu insulated composite concrete and steel wall structure.

The term "composite" is intended to mean that the hollow plastic modular construction blocks have reinforcing means, such as steel bars and metal tension members, incorporated therewith so that when freshly mixed, or wet, concrete is poured therewithin, the resultant is a monolithic, insulated, composite, reinforced, concrete wall structure. The term "insitu" is intended to mean that the fresh concrete is poured directly into the assembled plastic modular construction blocks, all of which jointly cooperate together to form a new monolithic "poured in place" structure that exhibits great structural strength.

Preferably, the modular block is marketed as a unitary module, less the concrete and rebar, to enable one to assemble the modules 12 into a structural hollow form, or mold, within which rebar is incorporated thereinto, and then recently mixed cementatious material, or wet concrete, subsequently is poured thereinto, thereby forming a monolithic concrete wall of great structural integrity, and having many unexpected advantages, including cost effectiveness as well as reduced heat loss, and rapid, low cost construction, but most important is the simple method of construction that is within the comprehension of most any handyman.

Moreover, decorative sheets of selected paneling material can be attached to the walls 13 and 14 of the resultant monolithic structure 10 to provide a conventional appearing interior wall surface of pleasing design and high quality.

Figure 2:
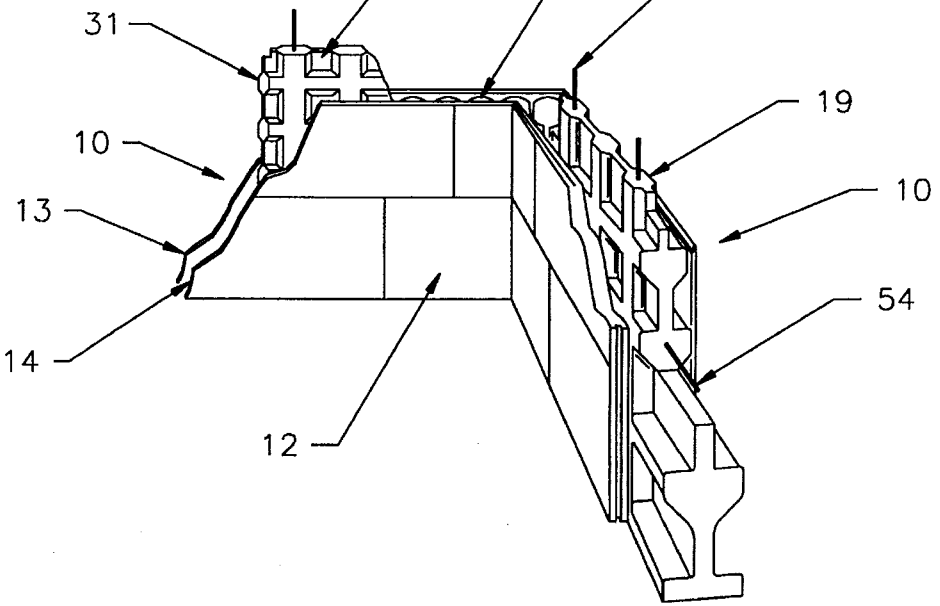
FIG. 2 is a fragmentary, broken, perspective view of a completed insitu insulated concrete wall structure of FIG. 1.

In FIG. 1, together with other figure of the drawings, there is disclosed the preferred embodiment of a modular construction block 12, made in accordance with this invention, by which the aforesaid wall structure 10 can be fabricated. The structural form provided by the blocks 12 is supported on a footing 11 of FIG. 1, ready to be filled with concrete, as shown in FIG. 2, wherein spaced apart sidewalls 13 and 14 are formed from the foam plastic walls of the module and provides a cavity 15 therebetween. Within the cavity 15 there is formed a reinforced concrete wall of unitary construction having spaced parallel vertical columns 19 resulting from the concrete that is subsequently poured thereinto.

Figure 3:
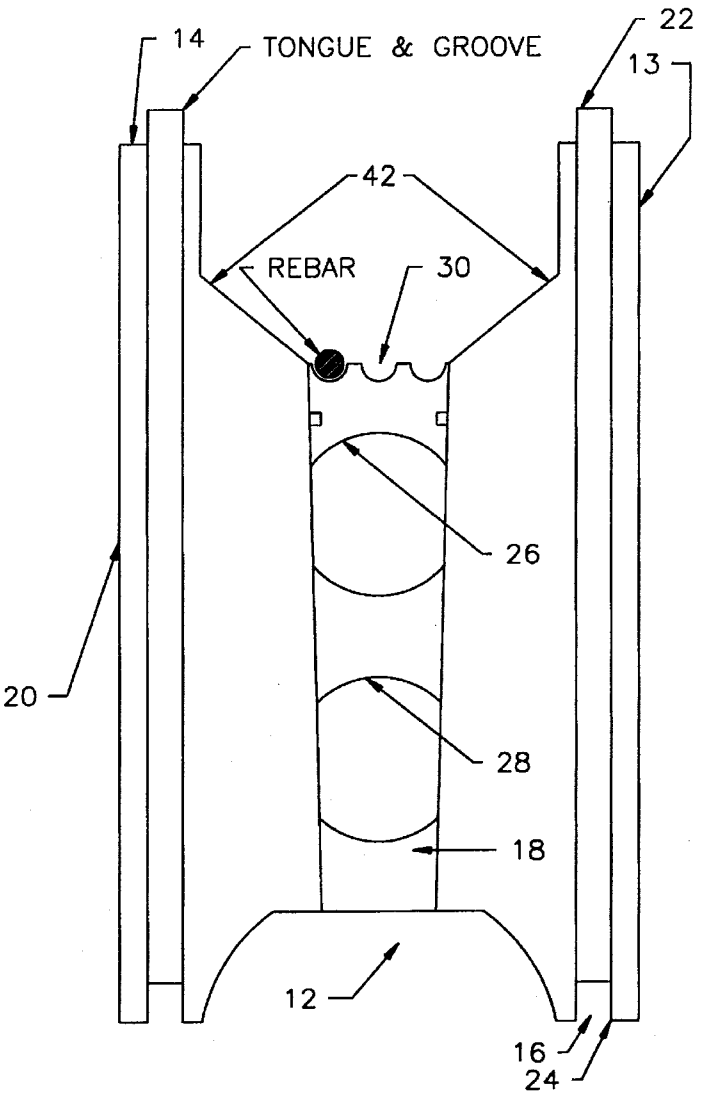
FIG. 3 is an end view of the apparatus of FIG. 1.
Figure 5:
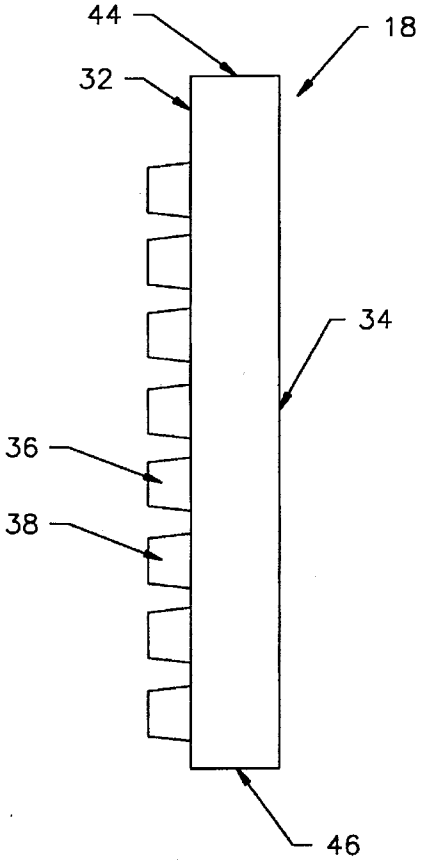
FIG. 5 is a side view of the apparatus disclosed in FIG. 4.
Figure 4:
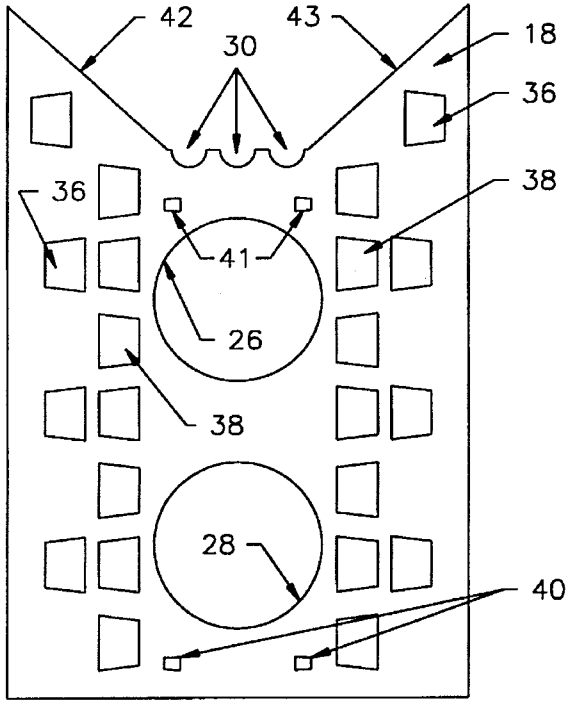
FIG. 4 is a plan view of pan of the apparatus disclosed in FIG. 3.

FIGS. 1 and 3 illustrate that the entire peripheral edge of the top 16 of each module 12 has an upwardly directed tongue formed thereon, while bottom 17 has a coacting tongue receiving groove formed thereon. A metal tension member 18, made of sheet metal, is suitably bent up to provide the structure best seen illustrated in FIGS. 1, 3, and 6–8 and particularly in FIGS. 4–7.

In FIG. 2, it should now be apparent that the before mentioned cavity 15 (also see FIG. 1) forms the illustrated vertical load bearing columns 19 when concrete is poured into the cavity between the confronting, spaced, walls 13 and 14. Note the intervening web attached intergrally between the aforesaid vertical columns 19.

In FIG. 1, 3, and 8–11 the ends 20 and 21 of the module 12 are likewise provided with coacting tongues and grooves to enable one end of one block to be releasably engaged with respect to the adjacent end of another block. The tongue and grooves located on the opposed upper and lower faces of the module 12 likewise enable adjacent rows of blocks to be releasably engaged with one another in the illustrated manner of FIG. 2. In FIG. 3, numerals 22 and 24, respectively, indicate the tongue and grooves, respectively, located at the top and bottom, respectively, of each of the modules.

Upper and lower bonding holes, 26 and 28, are formed in the tension member 18 to enable cementacious material to freely flow between the spaces formed in the module interior. Crescents 30 provide a rebar seat to support a length of rebar at any of the three illustrated locations. The front face 32 of tension member 18 is opposed to a rear face 34 thereof. Outer row 36 of tabs are bent 90 degrees, which is perpendicularly to the face 34, to firmly anchor the member 18 within the foam plastic that forms the insulated inner and outer walls. An inner row of tabs 38 are oppositely bent 90 degrees for optimum placement of the tabs 36 and 38 along a substantially straight line and therefore in a single row that is parallel to the opposed similarly arranged row of tabs. The tabs all are optumly positioned to become firmly anchored in the plastic material. Further, the cut-outs that form the tabs provide appertures through which the plastic can freely flow and thereby provide attachment at locations between the mass of material found on either side of the tension member 18. This arrangement of the opposed plastic walls associated with the member 18 anchors the tension member in the plastic and greatly increases its rigidity to avoid deformation due to the hydrostatic head of the wet concrete.

A pair of spaced apart alignment tabs 40 are located below lower hole 28, and above hole 26 at 41, and inside of the rows of tabs 38 for achieving exact alignment between the several tension members 18 and with respect to the mold cavity during the manufacture of the modules 12. This important feature of the invention greatly improves the accuracy with which the subsequent attachment of panel members can be made onto the inner wall surface of the inner wall 14 of the completed structure. The tabs 40, 141 are indexed with detents or small appertures that are formed during the manufacture of the metal molds (not shown) so that the styrofoam beads are molded or compressed about the tension member 18 in a manner that precisely positions the plurality of tension members respective to one another and to the resultant walls 13 and 14 thereof.

A large cutout is formed in the upper marginal end of the tension member 18 to provide a rebar seat at a location between the opposed 45 degree sloped walls 42, 43. The edges of the angled walls 42, 43 extend upwards into engagement respective to the upper end of the flanges at the top edge 44 of tension member 18. Hence the cut-out is in the form of a truncated inverted triangle having a truncation at 30 and a base at 44. The top edge 44 of the flanges 20 is opposed to the bottom edge 46 thereof. This feature of the invention provides a cantilever action between the weight of the rebar that is placed on the rebar seat and the upper edge 44 of the member 18.

Figure 6:
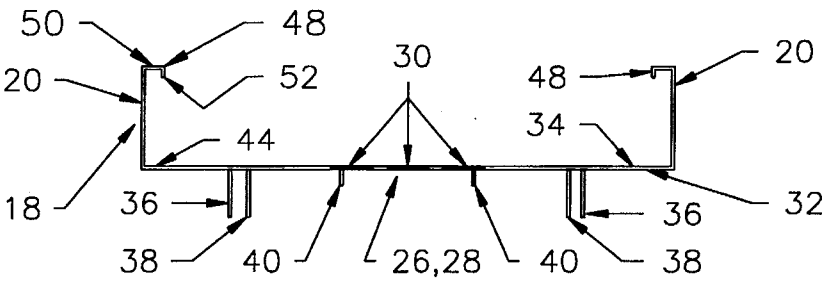
FIG. 6 is an enlarged, top plan view of the apparatus disclosed in FIG. 4 and 5.

In FIG. 6, it will be noted that the flange 20 extends rearwardly from the face 34 and receives a double bend at 50 to form a stiffner 48. The wall 50 of stiffner 48 terminates at 52. Lengths of rebar 54 and 56 are suitably tied in supported relationship on the cut-out and within the cavity to impart further strength into the monolithic concrete structure.

The entire flange 20, 20' along with the anchor tabs 36, 38 are embedded within the styrofoam body of the module, with the styrofoam encapsulating the tabs 36 and 38 and the flanges 48 or 58, thereby rigidfying the entire module and forming the before mentioned cavity for containment of the wet concrete. The outermost surface 20 of the flange 18 is therefore spaced about ¼ inch below the outermost surface of the styrofoam so that sheets of paneling, or the like, can more easily be screwed directly into the flange 20. After the concrete has set up, the location of the flanges is apparent from observing the module exterior wall surface. A self taping screw can be screwed into the flange face using an electric screwdriver to directly attach the paneling to the wall surface of either side of the structure.

A module has been successfully fabricated having the following dimensions: width 9.25 inches; length 4 foot; heighth 16 inches; tension member width 8.25 inches; height 12.5 inches; and the flange width 1.5 inches; height 12.5 inches; upper cut-out dimensions at re-bar seat 3 inches; anchoring tab size 1 inch ×0.75 inch; alignment tab size 0.25×0.25 inch; and 8 tabs each side arranged in two rows of four each to provide a total of 8 tabs aligned in two rows, or 16 anchor tabs in four rows; and additionally the two alignment tabs at each of the opposed ends of each tension member.

Figure 7:
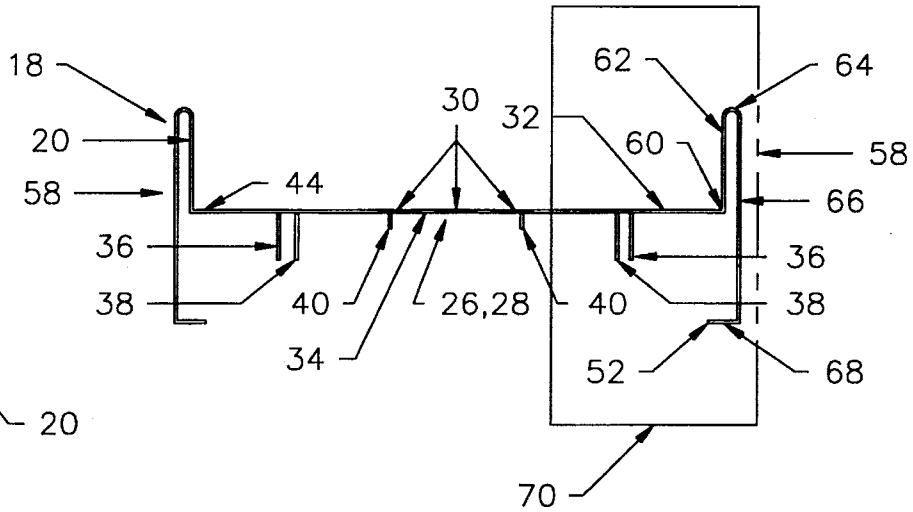
FIG. 7 is a top plan view of a modification of the apparatus disclosed in FIG. 6.

The confronting styrofoam walls may be secured one to the other by a plurality of the spaced tension members disclosed in FIGS. 4–8. The alternate embodiment of the tension member 18 of FIG. 7 is made of a unitary, perforated, bent up sheet of thin metal, and has opposed faces, 32,34, with a top end opposed to a bottom end, and opposed sides in the form of flanges that are arranged perpendicular to the faces thereof and parallel respective to the inner and outer wall surfaces of the confronting styrofoam walls. Upper and lower bonding holes 26,28 are formed through the central part of the tension member and have a diameter substantially about ⅓ the distance measured between the flanges and are arranged equidistant respective to the flanges. A double row of spaced tabs 36,38 result from the formation of relatively small appertures formed through the tension member. The small apertures are arranged in vertical rows on either side of the upper and lower bonding holes, and inwardly of the flanges, with there being an inner row 38 of a plurality of tabs and an outer row 36 of a plurality of tabs. The inner and outer rows of tabs are bent perpendicular respective to an opposed faces of the tension member and located thereon so as to be imbedded within the confronting styrofoam walls during manufacture thereof, thereby greating increasing the resistance to deformation occasioned by the hydrostatic head of the wet cement contained within the cavity of the module.

In operation, the individual modules are fabricated by placing the plurality of tension members 18 within the mold cavities, using the small apertures at alignment tabs 40 as alignment means by which the individual tension members 18 are precisely aligned with one another within the mold cavity, and also more perfectly aligned respective to the subsequently formed styrofoam walls 13 and 14. The small tabs 40 are received within a detent formed in one of the styrofoam mold halves. This detent, or locating hole, places the flanges 20 of the tension members precisely spaced ¼ inch below the outermost styrofoam wall surfaces of the completed product where they are readily accessible for subsequent attachment of paneling and the like thereto.

The first row of modules is placed on the concrete footing and arranged in a straight row, with adjacent ends being fastened together by the before mentioned tounge and groove arrangement. It is preferred that the lower end of the first module be pressed into the wet concrete to increase the resistance to lateral deformation of the lower end of the walls thereof. After several tiers of the modules have been built up, and the horizontal and vertical lengths of re-bar fled into the position of FIGS. 1 and 2, wet cement is poured within the cavity to a level slightly above a first tier of blocks, thereby tying or cementing the first and second tiers together with the wet cement, which will give a false set by the time the next level is poured. Care should be taken to commence pouring cement into the next tier of blocks before a cold joint can be formed. By preceding in this manner, the wet cement of the several pouring sessions is dispensed within a time interval that precludes curing of the sequiential pourings of the wet cement so that a cold joint is avoided, and more importantly, the hydrostatic head of the wet cement is held to a minimum, thereby avoiding exceeding the structural integrity of the system, which also precludes any lateral movement of the wall structure. Further, this procedure is ideal for the home craftsman who has the courage, or audacity, to construct his own home. The present invention enables the homebuilder to fabricate a long lasting, superior concrete structure at tremendous savings.

Figure 8:
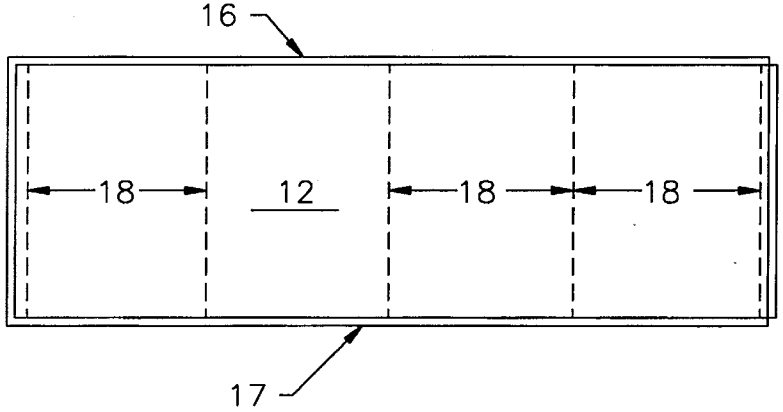
FIG. 8 is a side view of FIG. 3.
Figure 9:
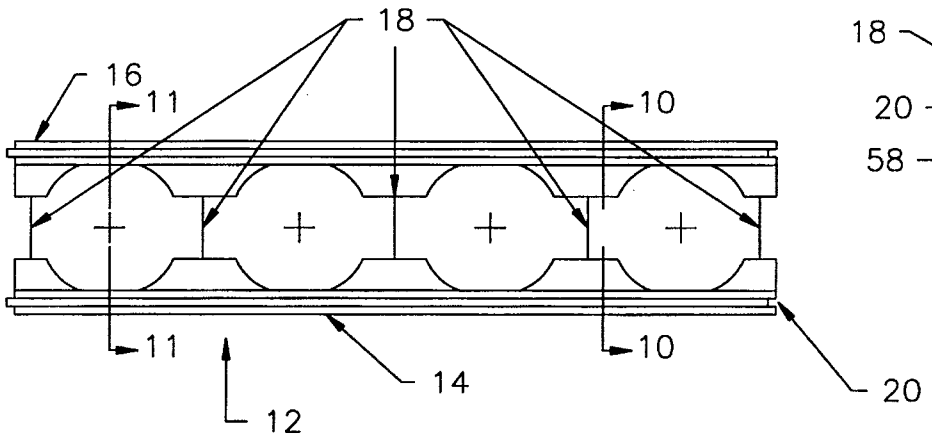
FIG. 9 is a top view of the structure of FIG. 8.
Figure 10:
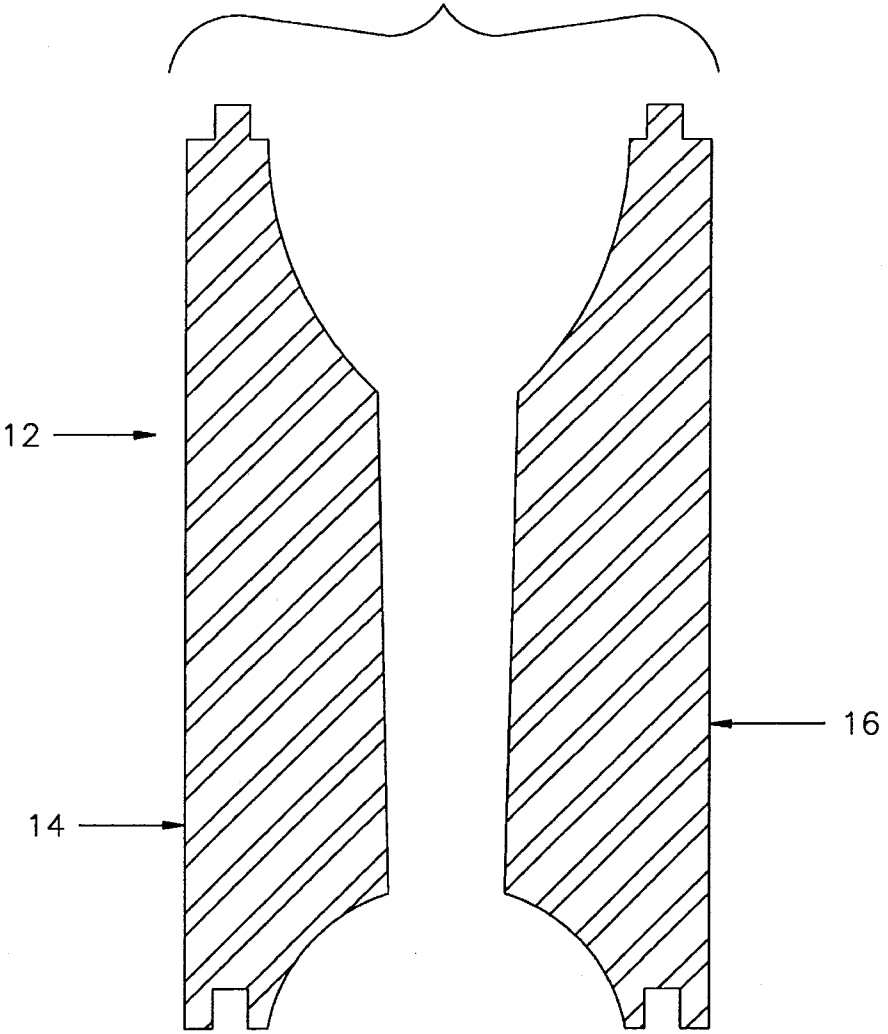
FIG. 10 is a longitudinal cross-sectional view of FIG. 9 taken along lines 10—13; and, FIG. 11 is a cross-sectional view of FIG. 9 taken along lines 11—13.
Figure 11:
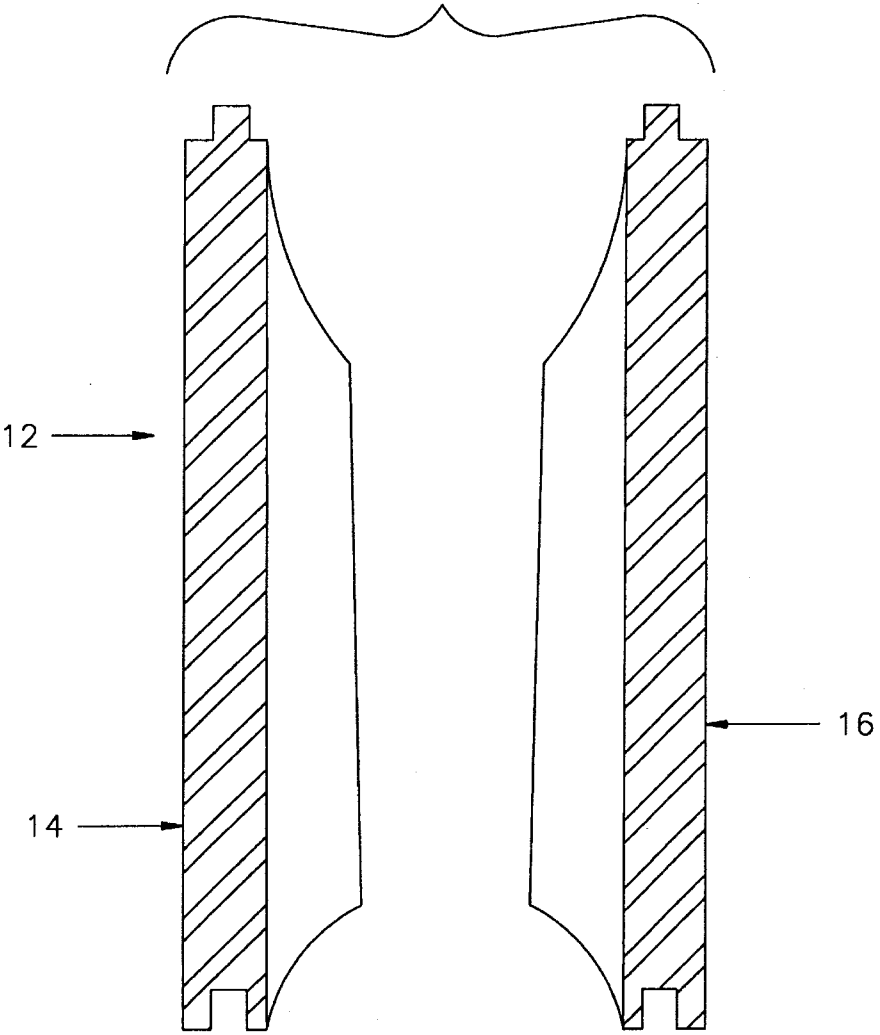

In FIG. 8, the modified flanges at 58 are made by a first bend at 60 at opposed marginal ends of the tension member. The first bend 60 is arranged perpendicular respective to the faces 32,34 thereof to form a marginal length 62 which is a doubled part of the flange. Next the 180 degree bend is made at 64 to form the entire flange face 66 as the marginal length 66 is doubled back onto the underlying marginal length 62; and then the remaining part 68 is bent perpendicular to face 66 of the flange 58 to form the stiffner which terminates at edge 52. It will be noted that the stiffner is located on the edge of flange 58 that is opposed to the 180 degree bend at 64. Numeral 70 indicates the relative position of the opposed sides of the tension member respective to the body 13 of styrofoam plastic material.

I claim:

1. A module comprising:

first and second foam panels each having inner and outer surfaces, said panels arranged in spaced parallel relation with their respective inner surfaces facing each other; and at least one tension member extending between and anchored within said panels, the tension member made of sheet metal;

each said tension member having a polygonal shape, opposed faces, a top, a bottom, and opposed sides;

the sides each including a flange anchored within the panels and extending perpendicular to said opposed faces of said tension member, said flanges extending in a first plane parallel to each other and the inner surfaces of said panels, each of the flanges bent 180 degrees back onto itself and extending in a second direction opposite said first direction, each of the flanges terminating in a free end, the free end being a stiffener;

the stiffener extending parallel to said opposed faces of said tension member;

upper and lower bonding holes formed through said tension member and having a diameter substantially about ⅓ the distance measured between said flanges and arranged equidistant said flanges; and spaced tabs formed on said tension member and arranged in vertical rows on either side of said bonding holes and inwardly of said flanges, apertures formed by said tabs.

2. The module of claim 1 wherein said tension member is a unitary bent-up sheet of metal having said stiffener formed at the outermost edge portion of each of the opposed flanges; said stiffener extends along the length of the flange and forms one marginal terminal end of said sheet of metal; and a re-bar support formed on the base of the cut-out for supporting a length of re-bar thereon.

3. The module of claim 1 and further including alignment tabs formed adjacent to opposed ends of the tension member for aligning the tension member with respect to a mold cavity within which the module may be fabricated to thereby dispose the opposed flanges parallel to and in close proximity of an outer surface of the confronting walls.

4. Method of building a monolithic wall structure of cementatious material encased within inner and outer walls that are assembled from a plurality of modules to provide a concrete form; comprising the steps of:

making each module into the form of a foam plastic block having spaced apart confronting sidewalls, opposed ends, a top opposed to a bottom; and, forming a cavity between said spaced apart confronting sidewalls of each block that is aligned with the cavities of the other modules to form vertical columns when concrete subsequently is poured into said cavity, thereby providing a concrete wall structure having outer walls attached on either side thereof;

rigidly spacing said confronting walls from one another and securing the walls together by embedding opposed ends of a tension member within the inner and outer walls of the modules to secure the confronting walls together and thereby resist lateral movement thereof;

deforming opposed marginal ends of said tension member into flanges and arranging the flanges respective to the inner and outer walls to provide a support for the subsequent attachment of decorative material, including paneling;

extending each marginal end in a first direction perpendicular respective to the opposed faces of the tension members and parallel respective to one another and to the confronting walls, and then bending a remaining marginal end of said tension member 180 degrees back onto itself to extend in an opposite direction respective to said first direction, and terminating the flange in a stiffener;

connecting the modules together by forming coacting tongue and grooves on the respective top, bottom, and opposed ends thereof.

5. The method of claim 4 and further including the steps of forming alignment tabs adjacent to an opposed upper and lower end of the tension member and aligning the tension member with a respect to a mold cavity during the molding of the module to thereby dispose the opposed flanges parallel to and near the outer surface of the opposed walls.

6. The method of claim 4 and further including the steps of:

forming an inner and outer row of tabs at a location between the flange and the holes, bending the tabs perpendicular to the faces of the tension member for anchoring the tension member inside of the confronting walls; thereby increasing the structural integrity of the module whereby the sidewalls thereof resist deformation when subjected to the hydrostatic head of wet concrete.

7. Apparatus for building an insitu insulated concrete wall structure:

the apparatus comprising a plurality of modules stacked together to form a unitary wall structure;

each module comprising first and second foam panels each having inner and outer surfaces, said panels arranged in spaced parallel relation with their inner surfaces facing each other; and at least one tension member extending between and anchored within said panels, the tension member made of sheet metal;

each said tension member having a polygonal shape, opposed faces, a top, a bottom, and opposed sides;

the sides each including a flange anchored within the panels and extending perpendicular to said opposed faces of said tension member, each of said flanges extending in a first plane parallel to each other and the inner surfaces of said panels, each of the flanges bent 180 degrees back onto itself and extending in a second direction opposite said first direction, each of the flanges terminating in a free end, the free end being a stiffener;

the stiffener extending parallel to said opposed faces of said tension member;

upper and lower bonding holes formed through said tension member and having a diameter substantially about ⅓ the distance measured between said flanges and arranged equidistant said flanges; and spaced tabs formed on said tension member and arranged in vertical rows on either side of said bonding holes and inwardly of said flanges, apertures formed by said tabs.

8. The apparatus of claim 7 wherein an inner and outer row of tabs is formed between the flanges and the holes, said tabs being arranged perpendicular to the faces of the tension member for anchoring the tension member within the interior of the confronting walls; and said re-bar seat is located above the large holes at a location that is subsequently filled with cementatious material.

9. The apparatus of claim 7 wherein said tension member is a unitary bent-up sheet of metal with said stiffener being a bent marginal terminal end of said flange.

10. The apparatus of claim 7 and further including alignment tabs formed adjacent opposed ends of the tension member for aligning the tension member with a respect to a mold cavity to thereby dispose the opposed flanges parallel to and near the outer surface of the wall during the molding of the module.

11. The apparatus of claim 7 and further including forming an inner and outer row of tabs at a location between the flange and the holes, bending the tabs perpendicular to the faces of the tension member for anchoring the tension member inside of the confronting walls; thereby increasing the structural integrity of the module whereby the sidewalls thereof resist deformation when subjected to the hydrostatic head of the wet concrete.

* * * * *